US010800027B1

(12) United States Patent
Christiansen

(10) Patent No.: US 10,800,027 B1
(45) Date of Patent: Oct. 13, 2020

(54) CONDUIT MARKING TOOL

(71) Applicant: Lachlan Christiansen, Haiku, HI (US)

(72) Inventor: Lachlan Christiansen, Haiku, HI (US)

( * ) Notice: Subject to any disclaimer, the term of this patent is extended or adjusted under 35 U.S.C. 154(b) by 146 days.

(21) Appl. No.: 16/209,073

(22) Filed: Dec. 4, 2018

(51) Int. Cl.
*B25H 7/00* (2006.01)
*B25H 7/04* (2006.01)

(52) U.S. Cl.
CPC ..... *B25H 7/005* (2013.01); *B25H 7/045* (2013.01)

(58) Field of Classification Search
CPC ..... B25H 7/045; B25H 7/005; G01B 7/003; G01B 3/04; G01B 3/563; G01C 15/04
USPC ..... 33/529, 21.1
See application file for complete search history.

(56) References Cited

U.S. PATENT DOCUMENTS 2,155,705 A * 4/1939 Gottwald ..... B23Q 35/42 269/2
2,742,706 A * 4/1956 Rushing, Jr. ..... B25H 7/005 33/529
4,195,827 A * 4/1980 Lyman ..... B23D 51/025 269/2
4,589,213 A 5/1986 Woodward
4,947,556 A 8/1990 Peil
5,058,407 A 10/1991 Parker
5,167,075 A 12/1992 Weldy et al.
6,209,215 B1 * 4/2001 Helms ..... G01B 5/207 33/529
6,601,312 B1 * 8/2003 Phuly ..... B23K 9/0286 33/529
D529,826 S 10/2006 Jordan et al.
7,251,902 B1 * 8/2007 Mueller ..... F16L 1/06 33/529
7,437,828 B1 * 10/2008 Rozmiarek ..... B26B 29/06 33/416
7,555,842 B1 * 7/2009 Asay ..... G01C 9/28 33/372
7,926,196 B2 * 4/2011 Mueller ..... B43L 13/205 33/529
8,296,959 B1 * 10/2012 Brooks ..... B25H 7/005 33/21.1
9,389,075 B2 7/2016 De Cino
9,885,571 B2 2/2018 Hoppe et al.
2003/0182811 A1 10/2003 Hairapetian
2007/0175059 A1 * 8/2007 Mueller ..... F16L 1/06 33/562
2017/0197457 A1 * 7/2017 Garr ..... B23B 5/16

* cited by examiner

*Primary Examiner* — Yaritza Guadalupe-McCall
(74) *Attorney, Agent, or Firm* — Cramer Patent & Design, PLLC; Aaron R. Cramer

(57) ABSTRACT

A conduit marking tool is fashioned as a rectangular prism having a bore passing through the center thereof. A plurality of perpendicular notches is disposed on one (1) of oppositely positioned frame faces. A set screw is disposed on a side of the tool between the faces. The tool permits a user to score or otherwise mark apportion of conduit for subsequent tasks.

20 Claims, 3 Drawing Sheets

CONDUIT MARKING TOOL

FIELD OF THE INVENTION

The present invention relates generally to the field of conduit marking tools.

BACKGROUND OF THE INVENTION

The use of Electrical Metallic Tubing or EMT is a common conduit system used in residential, commercial and industrial wiring installations and is a common method of distributing power and control wiring. It is easy to easy to store, transport and cut and provides a fairly high level of protection from physical damage. However, any special bends or offsets require the use of a manual conduit bender. While a conduit bender is a simple and low-cost tool, it still requires time and a great deal of skill to bend a conduit properly the first time. Such time and effort quickly translate to possible lost revenue on any job and it becomes magnified every time the conduit must be taken back down for additional bending. Most difficulties associated with bending EMT can be traced to the fact that the conduit is not properly marked. This is because of the round nature that makes it difficult to measure and mark with a linear instrument. Most workers simply eyeball equal marks around the perimeter of the conduit, with less than satisfactory results. Accordingly, there exists a need for a means by which EMT conduit can be accurately and evenly marked to allow for easy and proper bending. The development of the conduit marking tool fulfills this need.

SUMMARY OF THE INVENTION

The principles of the present invention provide for a conduit marking tool comprising a first face, a second face, a first side, a second side, a top side, a bottom side and a center bore disposed horizontally through the conduit marking tool. The center bore passes through the first face and the second face and is configured to slide about a portion of conduit.

The tool also comprises a first notch which is disposed within the top side having an opening at the first face and an end adjacent a center point of the first face, a second notch disposed within the first side having an opening at the first face and an end adjacent a center point of the first side, a third notch disposed within the bottom side having an opening at the first face and an end adjacent a center point of the bottom side, a fourth notch disposed within the second side having an opening at the first face and an end adjacent a center point of the second side and a conduit marking tool fastener disposed within the top side capable of being removably secured about the portion of conduit.

The conduit marking tool is disposed upon the portion of conduit the conduit marking tool permits a user to score or mark the portion of the conduit by running a scoring or writing instrument through the first notch, the second notch, the third notch and the fourth notch.

The tool may also comprise a plurality of tick marks radially disposed about an opening of the center bore. The plurality of tick marks comprises at least one first style tick mark and at least one second style tick mark. The second style tick mark being shorter in length than the first style tick mark. The tool may also comprise a fastener aperture and a threaded screw.

The plurality of tick marks may consist of a first style tick mark at 0°, a second first style tick mark at 45°, a third first style tick mark at 90°, a fourth first style tick mark 135°, a fifth first style tick mark at 180°, a sixth first style tick mark at 225°, a seventh first style tick mark at 270°, and an eighth first style tick mark at 315°. Additionally, eight second style tick marks are evenly disposed between each the first style tick marks.

The tool may have a length of 3 inches, a width of 1.5 inches and a diameter of the bore hole which is greater than 1 inch. The first, second, third and fourth notches may have a length of 1.5 inches. Furthermore, the first, second, third and fourth notches may each have a hemispherical closed end. The tool may be made of stainless steel or plastic.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
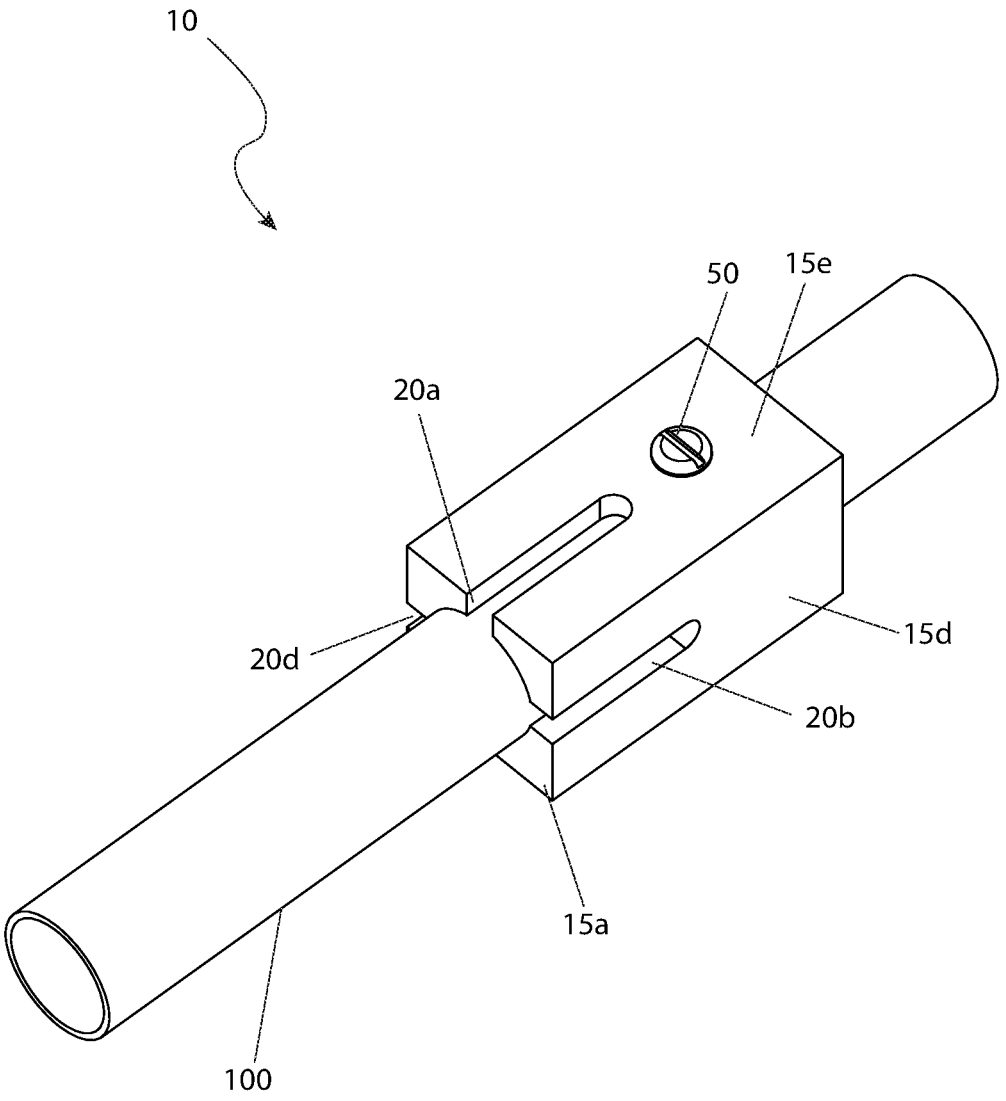
FIG. 1 is an environmental perspective view of a conduit marking tool 10, according to the preferred embodiment of the present invention; and, FIG. 2 is a first end view of the conduit marking tool 10, according to a preferred embodiment of the present invention.

5 center bore
10 conduit marking tool
15*a* first face
15*b* second face
15*c* first side
15*d* second side
15*e* top side
15*f* bottom side
20*a* first marking notch
20*b* second marking notch
20*c* third marking notch
20*d* fourth marking notch
25 first tick mark
26 second tick mark
30 bore
50 fastener
100 conduit

DESCRIPTION OF THE PREFERRED EMBODIMENTS

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, it is illustrated where a conduit marking tool (herein described as the "tool") 10 is installed over a portion of conduit 100 in order to facilitate a marking event in anticipation of bending, scoring, cutting or another similar task. For purposes of the present application, the term conduit 100 is understood to also refer to piping, fittings, cable, or other elongated tubular or solid members that marking thereon is desirable. Although the tool 10 is most preferably used to mark a cylindrical portion of conduit 100, it is appreciated that other geometrical shapes can be used with the tool 10. The tool 10 has an overall general shape of a rectangular prism having a preferred length of three inches (3 in.), and a preferred width and preferred height of one-and-a-half inches (1½ in.), although other sizes may be appreciated. The tool 10 is generally a unitary structure manufactured out of a resilient and weather-resistant and waterproof material, such as stainless steel, carbon steel, plastic, or hardwood. The tool 10 may be solid, partially, or fully hollow.

Figure 2:
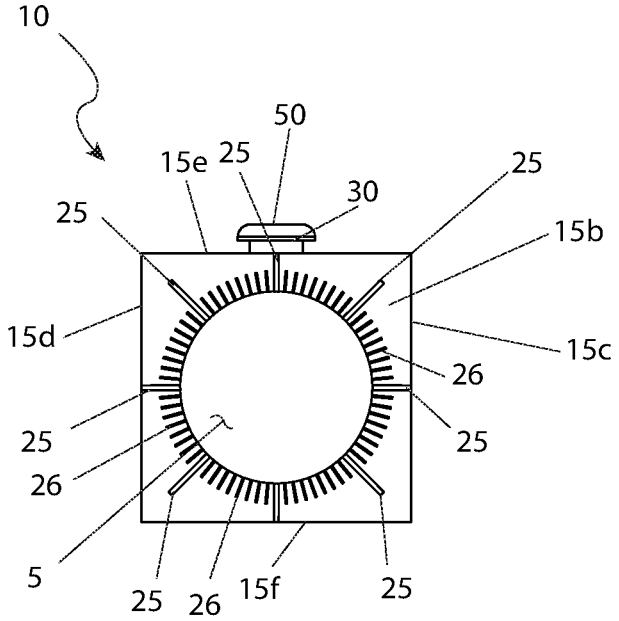
Figure 3:
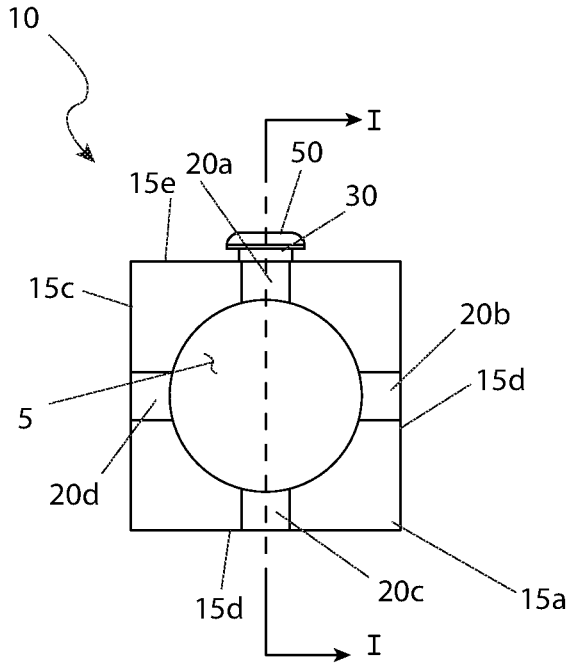
FIG. 3 is a second end view of the conduit marking tool 10, according to a preferred embodiment of the present invention; and, FIG. 4 is a cut-away view of the conduit marking tool 10, according to a preferred embodiment of the present invention.

Referring now to FIGS. 2 and 3, a view of a first face of the tool 10 and a view of the rear face of the tool 10. Passing through the longitudinal center of the tool 10, along a bisecting longitudinal center line and parallel with both the upper surface and lower surface is a center bore 5, through which the conduit 10 passes. The diameter of the center bore 5 can accommodate typical and conventional sizes (such as diameters and widths) of conduit 100. When a tool 10 has an exemplary set of dimensions as mentioned above, the preferred diameter of the center bore 5 is capable of accommodating conduit 100 with an outer diameter of one inch (1 in.). The location of the center bore 5 enables symmetrical load balancing of the tool 10 when installed on the conduit 100 during a marking event.

As mentioned above, the tool 10 is generally a rectangular prism, having a first face 15*a* comprising a first short side (herein illustrated as the front face) and a second face 15*b*, opposite said first face, comprising a second short side (herein illustrated as the rear face). A first side 15*c*, comprising a first long side (herein illustrated as the left side) conjoins a first edge (herein illustrated as the left side) of the first face 15*a* with a first edge (herein illustrated as the left side) of the second face 15*b*. A second side 15*d*, comprising a second long side (herein illustrated as the right side) conjoins a second edge (herein illustrated as the right side) of the first face 15*a* with a second edge (herein illustrated as the right side) of the second face 15*b*. A top side 15*e*, comprising a third long side (herein illustrated as the top side) conjoins a top edge (herein illustrated as the top side) of the first face 15*a* with a top edge (herein illustrated as the top side) of the second face 15*b*, as well as conjoining a top edge (herein illustrated as the top side) of the first side 15*c* with a top edge (herein illustrated as the top side) of the second side 15*d*. A bottom side 15*f*, comprising a fourth long side (herein illustrated as the bottom side) conjoins a bottom edge (herein illustrated as the bottom side) of the first face 15*a* with a bottom edge (herein illustrated as the bottom side) of the second face 15*b*, as well as conjoining a bottom edge (herein illustrated as the bottom side) of the first side 15*c* with a bottom edge (herein illustrated as the bottom side) of the second side 15*d*. Each face 15*a*, 15*b*, and each side 15*c*, 15*d*, 15*e*, 15*f* is planar.

Formed along the top side 15*e* and extending from a perimeter edge of the first face 15*a* rearwardly (i.e., towards the second face 15*b*) is a first marking notch 20*a*. Similarly formed along the second side 15*d* and extending from a perimeter edge of the first face 15*a* rearwardly (i.e., towards the second face 15*b*) is a second marking notch 20*b*. Similarly formed along the bottom side 15*f* and extending from a perimeter edge of the first face 15*a* rearwardly (i.e., towards the second face 15*b*) is a third marking notch 20*c*. Similarly formed along the first side 15*c* and extending from a perimeter edge of the first face 15*a* rearwardly (i.e., towards the second face 15*b*) is a fourth marking notch 20*d*. Each marking notch 20*a*, 20*b*, 20*c*, 20*d* terminates approximately halfway along its respective side 15*e*, 15*d*, 15*f*, 15*c*. In the exemplary embodiment illustrated herein, this would be approximately one-and-a-half inches (1½ in.). Each marking notch 20*a*, 20*b*, 20*c*, 20*d* extends inwardly to terminate at the center bore 5. It is preferred that the marking notches 20*a*, 20*b*, 20*c*, 20*d* are located along a bisecting longitudinal center line of the respective side 15*e*, 15*d*, 15*f*, 15*c*. The width of each marking notch 20*a*, 20*b*, 20*c*, 20*d* enables a marking tool (e.g. marker, pencil, wax, scoring tool) to pass therethrough such that the marking tool can affect a mark on the conduit 100. Such a mark in an exemplary embodiment is one-eighth-of-an-inch (⅛ in.) thick.

Referring more closely to FIG. 2, it can be seen that there are markings 25, 26 imprinted, embossed, or otherwise present on the second face 15*b*. Such markings are preferably radial markings 25, 26. For purposes of illustration, they are categorized as a plurality of first tick marks 25 and a plurality of second tick marks 26. The first tick marks 25 are longer and denote larger values. The second tick marks 26 are shorter and reflect smaller values. In the preferred embodiment, as illustrated herein, the first tick marks represent forty-five-degree (45°) increments and the second tick marks 26 represent five-degree (5°) increments. It is appreciated that these markings 25, 26 can be present on either the first face 15*a*, second face 15*b*, or both faces 15*a*, 15*b* and fall under the scope of the present invention. The present if these markings 25, 26 further aids a user in providing accurate markings with the tool 10 on the desired conduit 100.

Figure 4:
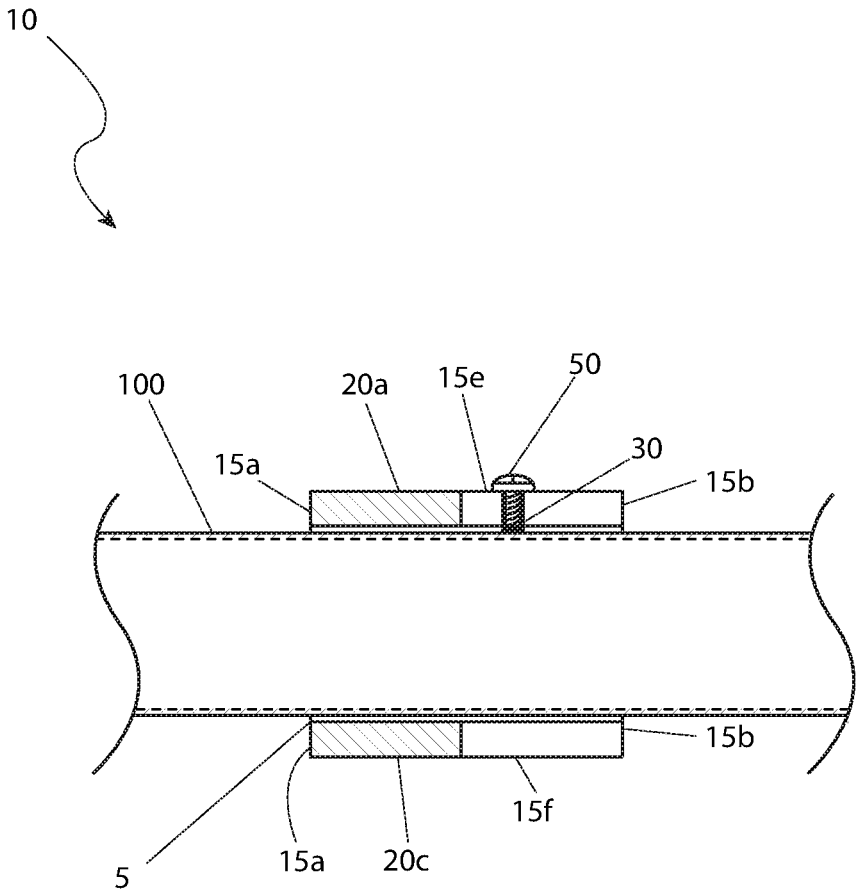

Referring now to FIG. 4, a cut-away view of the tool 10 with the conduit 110 passing through the center bore hole. A bore 30 is formed on the top side 15*e* of the tool 10 and passes through to the center bore 5. A fastener 50 is removably attached to the bore 30 and capable of removably securing the tool 10 to the conduit 100. Such a fastener 50 can be a set screw, as illustrated in the exemplary embodiment. It is appreciated that the bore 30 can be present in any of the faces 15*a*, 15*b*, or sides 15*c*, 15*d*, 15*e*, 15*f* of the tool 10 and still fall under the scope of the present invention.

2. Operation of the Preferred Embodiment

The preferred embodiment of the present invention can be utilized by the common user in a simple and effortless manner with little or no training. It is envisioned that the tool 10 would be constructed in general accordance with FIG. 1 through FIG. 4. The user would procure the tool 10 through normal procurement channels while paying attention to specifics such as overall size of the tool 10 and overall size (i.e. outer diameter) of the conduit 100.

The tool 10 can be installed over the portion of the conduit 100 to be marked, by sliding the portion of the conduit 100 through the center bore 5 of the tool 10. If so desired, the fastener 50 can be adjusted through the bore 30 to secure the tool 10 to the conduit 100. Use of the tick marks 25, 26 can aid in positioning the tool 10 radially about the circumference of the conduit 100 until a desired position is reached. A marking tool can pass through any of the marking notches 10*a*, 20*b*, 20*c*, 20*d* to mark the conduit 100. Repositioning the tool 10 about the circumference of the conduit 100, with or without the use of the tick marks 25, 26, to add subsequent marks through any of the marking notches 20*a*, 20*b*, 20*c*, 20*d* can be utilized.

The foregoing descriptions of specific embodiments of the present invention have been presented for purposes of illustration and description. They are not intended to be exhaustive or to limit the invention to the precise forms disclosed, and obviously many modifications and variations are possible considering the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A conduit marking tool comprising:

a first face;

a second face;

a first side;

a second side a top side;

a bottom side;

a center bore disposed horizontally through said conduit marking tool, said center bore passing through said first face and said second face;

wherein said center bore is configured to slide about a portion of conduit;

a first notch disposed within said top side having an opening at said first face and an end adjacent a center point of said first face;

a second notch disposed within said first side having an opening at said first face and an end adjacent a center point of said first side;

a third notch disposed within said bottom side having an opening at said first face and an end adjacent a center point of said bottom side;

a fourth notch disposed within said second side having an opening at said first face and an end adjacent a center point of said second side; and, a conduit marking tool fastener disposed within said top side capable of being removably secured about said portion of conduit; and, wherein when said conduit marking tool is disposed upon said portion of conduit said conduit marking tool permits a user to score or mark said portion of said conduit by running a scoring or writing instrument through said first notch, said second notch, said third notch and said fourth notch.

2. The tool of claim 1 wherein said second face comprises a plurality of tick marks radially disposed about an opening of said center bore.

3. The tool of claim 2 wherein said plurality of tick marks comprises at least one first style tick mark.

4. The tool of claim 3 wherein said plurality of tick marks comprises at least one second style tick mark, said second style tick mark being shorter in length than said first style tick mark.

5. The tool of claim 4 wherein said conduit marking tool fastener comprises a fastener aperture and a threaded screw.

6. The tool of claim 3 wherein said plurality of tick marks further comprises a first style tick mark at 0°, a second first style tick mark at 45°, a third first style tick mark at 90°, a fourth first style tick mark 135°, a fifth first style tick mark at 180°, a sixth first style tick mark at 225°, a seventh first style tick mark at 270°, and an eighth first style tick mark at 315°.

7. The tool of claim 6 wherein eight second style tick marks are evenly disposed between each said first style tick marks.

8. The tool of claim 1 wherein said tool has a length of 3 inches.

9. The tool of claim 8 wherein said tool has a width of 1.5 inches.

10. The tool of claim 9 wherein a diameter of said bore hole is greater than 1 inch.

11. The tool of claim 1 wherein said first notch has a length of 1.5 inches.

12. The tool of claim 11 wherein said second notch has a length of 1.5 inches.

13. The tool of claim 12 wherein said third notch has a length of 1.5 inches.

14. The tool of claim 13 wherein said fourth notch has a length of 1.5 inches.

15. The tool of claim 14 wherein said fourth notch has a hemispherical base closed end.

16. The tool of claim 13 wherein said third notch has a hemispherical base closed end.

17. The tool of claim 12 wherein said second notch has a hemispherical closed end.

18. The tool of claim 11 wherein said first notch has a hemispherical closed end.

19. The tool of claim 1 comprising stainless steel.

20. The tool of claim 1 comprising plastic.

* * * * *